US011476589B2

(12) United States Patent
Pourmousavi

(10) Patent No.: US 11,476,589 B2
(45) Date of Patent: Oct. 18, 2022

(54) ANTENNA ELEMENT AND ANTENNA ARRAY

(71) Applicant: Robert Bosch GmbH, Stuttgart (DE)

(72) Inventor: Mehran Pourmousavi, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 51 days.

(21) Appl. No.: 16/766,770

(22) PCT Filed: Nov. 22, 2018

(86) PCT No.: PCT/EP2018/082296
§ 371 (c)(1),
(2) Date: May 26, 2020

(87) PCT Pub. No.: WO2019/141412
PCT Pub. Date: Jul. 25, 2019

(65) Prior Publication Data

US 2021/0005978 A1 Jan. 7, 2021

(30) Foreign Application Priority Data

Jan. 18, 2018 (DE) ..... 102018200758.6

(51) Int. Cl.
*H01Q 21/00* (2006.01)
*H01Q 9/04* (2006.01)
(Continued)

(52) U.S. Cl.
CPC ..... *H01Q 21/0075* (2013.01); *H01Q 9/0407* (2013.01); *H01Q 9/16* (2013.01); *H01Q 21/065* (2013.01); *H01Q 1/3233* (2013.01)

(58) Field of Classification Search
CPC ..... H01Q 21/0006; H01Q 21/0075; H01Q 21/065; H01Q 9/04; H01Q 9/0407;
(Continued)

(56) References Cited

U.S. PATENT DOCUMENTS 4,063,245 A * 12/1977 James ..... H01Q 13/206 343/846
4,173,019 A * 10/1979 Williams ..... H01Q 21/062 343/846

(Continued)

FOREIGN PATENT DOCUMENTS

JP S5481757 A 6/1979
JP 2001111332 A 4/2001

(Continued)

OTHER PUBLICATIONS

International Search Report for PCT/EP2018/082296, dated Feb. 25, 2019.

(Continued)

*Primary Examiner* — Jason Crawford
(74) *Attorney, Agent, or Firm* — Norton Rose Fulbright US LLP; Gerard Messina

(57) ABSTRACT

An antenna element having: a feed line for feeding in electrical power; and a first multiplicity of radiating elements situated on a first side of the feed line, and a second multiplicity of radiating elements situated on a second side of the feed line, the radiating elements being coupled in series to the feed line, being fed with electrical power by the feed line, and being designed to transmit electromagnetic radiation; the first multiplicity of radiating elements differing from the second multiplicity of radiating elements in a distribution of spatial dimensions of the radiating elements and/or in a distribution of distances of adjacent radiating elements.

17 Claims, 5 Drawing Sheets

(51) Int. Cl.
*H01Q 9/16* (2006.01)
*H01Q 21/06* (2006.01)
*H01Q 1/32* (2006.01)

(58) Field of Classification Search
CPC ..... H01Q 9/16; H01Q 1/3233; H01Q 11/12; H01Q 11/14
See application file for complete search history.

(56) References Cited

U.S. PATENT DOCUMENTS 4,203,116 A * 5/1980 Lewin ..... H01Q 13/206 343/846
4,238,798 A * 12/1980 Aitken ..... H01Q 3/22 343/846
5,309,409 A * 5/1994 Jones ..... H01Q 3/26 367/126
5,367,307 A * 11/1994 Dupuis ..... H01Q 21/065 343/731
6,424,298 B1 * 7/2002 Nishikawa ..... H01Q 21/065 343/700 MS
8,502,733 B1 * 8/2013 Negus ..... H01Q 3/2617 342/359
9,236,664 B2 * 1/2016 Hayakawa ..... H01Q 9/045
9,252,485 B2 * 2/2016 Haskell ..... H01Q 3/2694
9,768,512 B2 * 9/2017 Park ..... H01Q 1/48
9,806,419 B2 * 10/2017 Uno ..... H01Q 21/0075
10,158,181 B2 * 12/2018 Kim ..... H01Q 21/065
10,418,714 B2 * 9/2019 Liao ..... H01Q 1/48
10,516,217 B2 * 12/2019 Fujita ..... H01Q 1/526
10,673,121 B2 * 6/2020 Hughes ..... E06B 7/28
2004/0080455 A1 * 4/2004 Lee ..... H01Q 21/065 343/700 MS
2007/0182635 A1 * 8/2007 Jeung ..... H01Q 21/062 343/700 MS
2007/0279303 A1 * 12/2007 Schoebel ..... H01Q 21/0075 343/700 MS
2010/0026584 A1 * 2/2010 Nakabayashi ..... H01Q 21/065 343/893
2010/0171666 A1 * 7/2010 Mizutani ..... H01Q 21/0037 343/700 MS
2016/0190703 A1 * 6/2016 Hosono ..... H01Q 13/206 343/700 MS
2016/0248159 A1 * 8/2016 Shiozaki ..... H01Q 13/206
2016/0329639 A1 * 11/2016 Kasahara ..... H01Q 13/22
2016/0365643 A1 * 12/2016 Hosono ..... H01Q 1/48
2017/0005405 A1 * 1/2017 Kim ..... H01Q 13/206
2018/0139848 A1 * 5/2018 Tateoka ..... B32B 27/322
2021/0005978 A1 * 1/2021 Pourmousavi ..... H01Q 21/0075
2021/0063605 A1 * 3/2021 Raeker ..... G02F 1/0063
2022/0059937 A1 * 2/2022 Kuo ..... H01Q 13/206

FOREIGN PATENT DOCUMENTS

JP 2006109425 A 4/2006
JP 2015091108 A 5/2015

OTHER PUBLICATIONS

Yuki Hayashi et al., "Millimeter-Wave Microstrip Comb-Line Antenna Using Reflection—Canceling Slit Structure", IEEE Transactions On Antennas and Propagation, US, vol. 59, No. 2, 2011, pp. 398-406. XP055552461.
Dapeng Wu, "76-81 GHZ Planar Antenna Development and Utilization for Automotive Radar Applications", Chalmers University of Technology, Gothenburg, Sweden, 2016, pp. 1-47. XP055552462.
K Balmain et al., "Asymmetry Phenomenon of Log-Periodic Dipole Antennas", IEEE Transactions On Antennas and Propagation, 1976, pp. 402-410. XP055552466.

* cited by examiner

ANTENNA ELEMENT AND ANTENNA ARRAY

FIELD

The present invention relates to an antenna element and an antenna array.

BACKGROUND INFORMATION

Radar devices enable a precise determination of relative speeds of objects, and, with the use of suitable modulation methods, of distances or angular positions of the objects as well. For this reason, radar devices are widely used in the automotive field.

In the gigahertz range, patch antennas are typically used. These can be provided on radiofrequency substrates particularly simply and at low cost. A metal surface whose length is approximately half the wavelength of the radar radiation is used here as a resonator.

The radiating element can be for example a single patch. Frequently, however, a better focusing of the radar radiation is required, i.e., an improved directional characteristic with narrower lobes. In panel antennas, a plurality of patches are therefore combined. In such an antenna array, all the patches are coupled to a common source that feeds electrical power into the patches. The coupling can be done in parallel or also in series using a power divider network.

U.S. Patent Application Publication No. US2007/0279303 A1 describes an antenna structure for antenna elements that are fed in series in this way. In order to improve the radiation characteristic, this document describes varying the distances between antenna elements or the dimensions of the antenna elements. For example, the distances between successive antenna elements can increase in the direction towards the end of a common feed line.

Typically, the antenna elements, or antennas, are designed in such a way that the main lobe, or main direction of transmission, of the transmitted radar radiation runs perpendicular to the substrate. In some applications, however, it can be advantageous to adapt the directional characteristic of the antennas so that the main direction of transmission does not run perpendicular to the substrate, but rather encloses a certain angle. In particular in radar devices that are positioned in the rear area of a vehicle or in the corner areas, such an adaptation of the directional characteristic may be advantageous.

A conventional mechanism for achieving strong directional effects is provided by phased array antennas. These are phase-controlled group antennas having a multiplicity of individual radiators configured in a matrix, in which a phase angle of the individual radiators is adjustable. Through suitable controlling, the transmission energy in the desired direction can be reinforced through constructive interference, and can be reduced or suppressed in undesired directions through destructive interference.

However, phased array antennas require relatively complicated mechanisms for the adaptation of the phases of the respective individual radiators. As a result, such antennas are typically relatively cost-intensive and complex to produce. Phased array technology is therefore frequently used in military applications, but its possible applications in the automotive field are rather limited.

There is therefore a need for low-cost antennas having directional effects that differ from the perpendicular direction.

SUMMARY

The present invention provides an antenna element and an antenna array.

Preferred specific embodiments of the present invention are described herein.

According to a first aspect, the present invention provides an example antenna element having a feed line for feeding in electrical power. The antenna element further has a first multiplicity of radiating elements that are situated on a first side of the feed line. In addition, the antenna element has a second multiplicity of radiating elements that are situated on a second side of the feed line. The radiating elements are coupled in series to the feed line, and are fed with electrical power by the feed line. The radiating elements are in addition designed to transmit electrical radiation. The first multiplicity of radiating elements differs from the second multiplicity of radiating elements in a distribution of spatial dimensions of the radiating elements and/or in a distribution of distances between adjacent radiating elements.

According to a second aspect, the present invention provides an antenna array having a multiplicity of antenna elements that are fed in common.

Through the use of radiating elements having different distributions of the spatial dimensions, or distances, a desired directional effect can be achieved even for a single antenna element. The constructive and destructive interference of the transmitted radar waves are responsible for this. Because the radiating elements are differently distributed on the two sides of the feed line, as a sum there results a main lobe that differs from the perpendicular direction of the substrate. In this way, a highly sensitive antenna can be provided.

In addition, additional measures for forming the radar beams, in particular pins and reactive elements, which can negatively influence the radiated power, can be omitted. In comparison with phased array antennas, the antenna element is further distinguished by a compact construction, because additional phase dividers can be omitted. This is advantageous in particular in automotive applications, where the available spaces must be optimally exploited.

Because an additional phase controlling by a phase divider is not required, a particularly low-cost antenna having a specified directional characteristic can be provided.

"Spatial dimensions" can be understood as referring to a width and a length of the corresponding radiating element, for rectangular patches or radiating elements. For radiating elements that are not rectangular in design, the spatial dimensions can be understood for example as the diameters or surface areas of the radiating elements.

A distribution of the spatial dimensions is to be understood as the sequence of the dimensions along the feed line. "Different distributions" thus preferably means not only that the radiating elements are configured offset to one another on the two sides of the feed line, but also that, at at least one location, the sequences of the distances or dimensions of the radiating elements on one side cannot be brought into agreement with corresponding sequences of the distances or dimensions of the radiating elements on the other side.

Preferably, the antenna element is a panel antenna that is situated in planar fashion on a substrate.

Through the suitable choice of the dimensions of, and the distances between, the radiating elements, an adequately high level of radiated power can be achieved in a wide angular region.

According to a preferred development of the antenna element according to the present invention, the distributions of the dimensions and/or distances include a Dolph-Chebyschev distribution, a uniform distribution, and/or a binomial distribution.

According to a development of the antenna element according to the present invention, the radiating elements of the first multiplicity and/or of the second multiplicity of the radiating elements are realized as slotted patches.

According to a preferred development of the antenna element according to the present invention, the radiating elements are coupled to the feed line via striplines. According to further specific example embodiments, however, the radiating elements can also be coupled to the feed line by capacitive couplings and/or slot couplings.

According to a further development of the antenna element according to the present invention, the antenna element is designed as a dipole antenna element.

According to a preferred development of the antenna element according to the present invention, the feed line and/or the radiating elements are designed as strip elements. The antenna element can thus be in particular a stripline antenna element.

According to a preferred development of the antenna element according to the present invention, the first multiplicity of radiating elements is configured so as to be offset relative to the second multiplicity of radiating elements along the feed line.

According to a specific embodiment of the antenna element according to the present invention, the distances between the radiating elements on both sides can be constant or can have the same distribution, while the distributions of the dimensions differ.

According to a further specific embodiment of the antenna element according to the present invention, the dimensions of the radiating elements on both sides can be constant or can have the same distribution, while the distributions of the distances between successive antenna elements for the two sides, i.e., for the first multiplicity of radiating elements and the second multiplicity of radiating elements, differ.

According to a preferred development of the antenna element according to the present invention, the at least one radiating element of the first multiplicity of radiating elements differs from all the radiating elements of the second multiplicity of radiating elements in the width and/or in the distance to an adjacent radiating element of the first multiplicity of radiating elements.

According to a preferred further development of the antenna element according to the present invention, the distributions of the dimensions and/or distances are selected in such a way that a radiation maximum of the transmitted electromagnetic radiation occurs at a direction of radiation that differs from a perpendicular direction.

BRIEF DESCRIPTION OF THE DRAWINGS

In all Figures, identical or functionally identical elements and devices are provided with the same reference characters.

DETAILED DESCRIPTION OF EXAMPLE EMBODIMENTS

Figure 1:
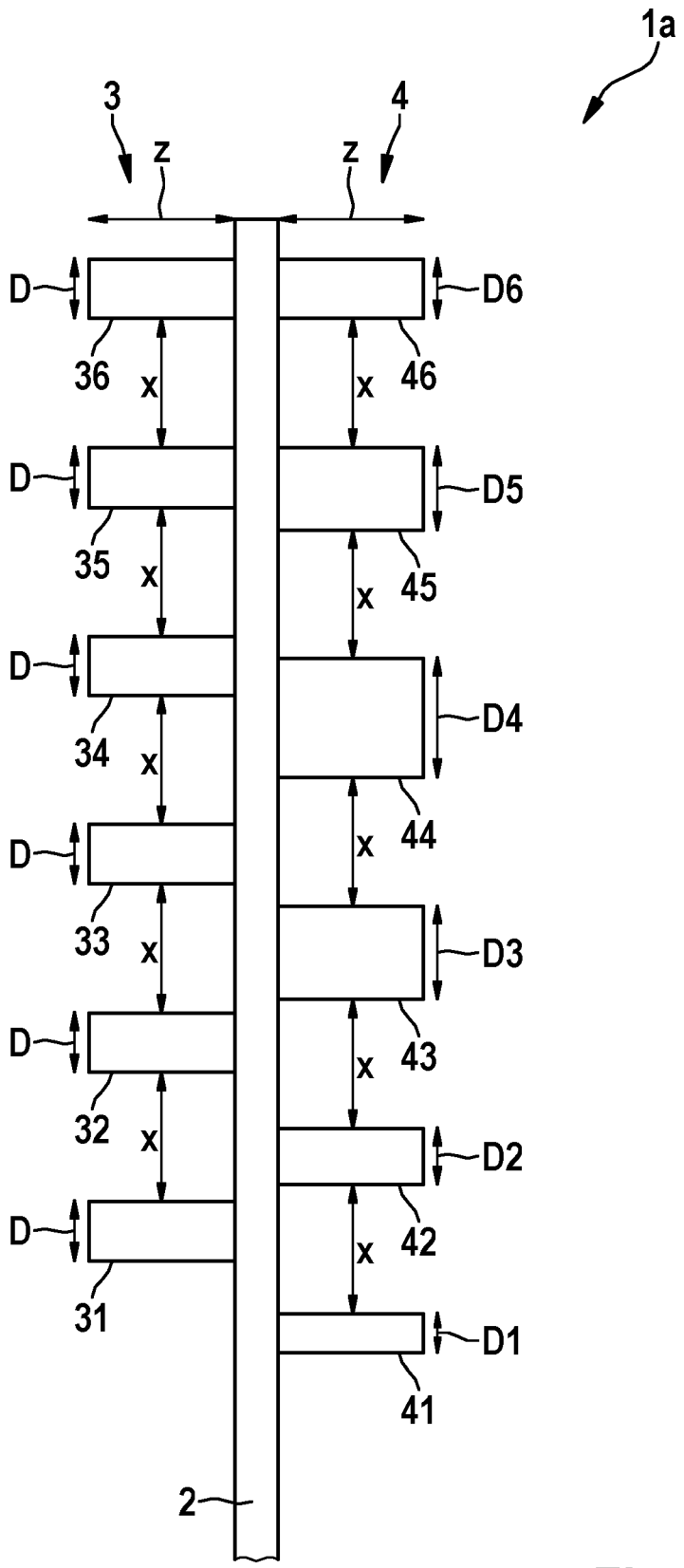
FIG. 1 shows a schematic top view of an antenna element according to a specific embodiment of the present invention.

FIG. 1 illustrates an example of an antenna element 1*a* in accordance with an example embodiment of the present invention. Antenna element 1*a* is realized as a panel antenna element that is fashioned on a substrate (not shown). Antenna element 1*a* can be realized as a radar transmitter device or as a radar receiver device. Antenna element 1*a* can also be an element of an antenna array.

Antenna element 1*a* has a feed line 2 that runs in a straight line, realized as a stripline. However, the present invention is not limited to this. Thus, feed line 2 need not necessarily run in a straight line.

Feed line 2, planar in design, has radiating elements 31 to 36 and 41 to 46 situated on a first, or left, side of feed line 2 and on a second, or right, side of feed line 2. Radiating elements 31 to 36 and 41 to 46 are realized as patches that are connected or coupled directly to feed line 2.

However, the present invention is not limited to such an embodiment. Thus, radiating elements 31 to 36 and 41 to 46 can be coupled to the feed line via coupling elements, such as strip elements connected to feed line 2. According to further specific embodiments, radiating elements 31 to 36 and 41 to 46 can also be coupled to feed line 2 via capacitive couplings and/or slot couplings.

Electrical power is fed to radiating elements 31 to 36 and 41 to 46 via feed line 2. Radiating elements 31 to 36 and 41 to 46 are in this way excited so as to transmit electromagnetic waves, preferably radar radiation. In particular, antenna element 1*a* can be designed to transmit radar waves in the gigahertz range, in particular for operation in the 77 gigahertz frequency band, which is widely used in automotive applications.

Radiating elements 31 to 36 and 41 to 46 can be subdivided into a first multiplicity 3 of radiating elements 31 to 36 on the left, or first, side of feed line 2 and a second multiplicity 4 of radiating elements 41 to 46 on the right, or second, side of feed line 2. In each case, the first multiplicity 3 of radiating elements 31 to 36, or the second multiplicity 4 of radiating elements 41 to 46, are coupled in series to feed line 2.

In the embodiment shown in FIG. 1, first multiplicity 3 of radiating elements 31 to 36 differs from second multiplicity 4 of radiating elements 41 to 46 in the distribution of the widths of radiating elements 31 to 36 and 41 to 46. Both radiating elements 31 to 36 of first multiplicity 3 of radiating elements 31 to 36 and radiating elements 41 to 46 of second multiplicity 4 of radiating elements 41 to 46 are realized in rectangular fashion and have identical length z, which is measured orthogonally to feed line 2. In addition, the distances x between successive radiating elements 31 to 36 and 41 to 46 are identical in each case. The distances x preferably correspond to the wavelength of the transmitted radar radiation.

Widths D of radiating elements 31 to 36 of first multiplicity 3 of radiating elements 31 to 36 are fixed in each case. Here, widths D are measured parallel to feed line 2. First multiplicity 3 of radiating elements 31 to 36 thus has a uniform distribution of the widths.

Widths D1 to D6 of radiating elements 41 to 46 of second multiplicity 4 of radiating elements 41 to 46 follow a Dolph-Chebyschev distribution. The ratio of widths D1 to D6 thus corresponds to the ratio of Chebyschev polynomials. According to a further specific embodiment, widths D1 to D6 can follow any other distribution, for example a binomial distribution. The radiation characteristic of antenna element 1*a* can be set via the choice of suitable distributions.

According to further specific embodiments, in addition or alternatively the lengths z of radiating elements 31 to 36 and 41 to 46 can vary. Preferably, the distribution of the lengths z of first multiplicity 3 of radiating elements 31 to 36 differs from the distribution of the lengths z of second multiplicity 4 of radiating elements 41 to 46.

According to further specific embodiments, in addition or alternatively the distances x between successive radiating elements 31 to 36 and 41 to 46 can vary. Preferably, the distribution of the distances x of first multiplicity 3 of radiating elements 31 to 36 differs from the distribution of the distances x of second multiplicity 4 of radiating elements 41 to 46.

Figure 2:
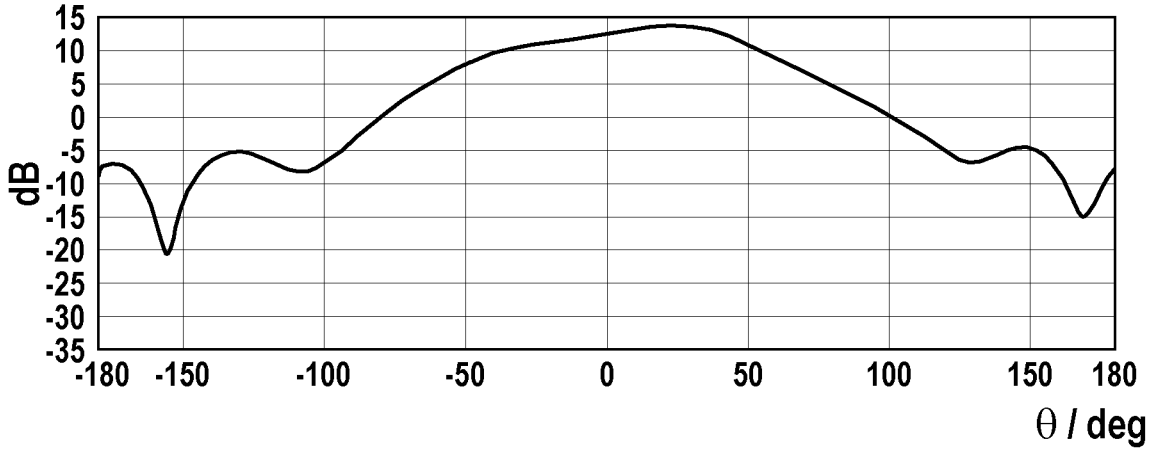
FIG. 2 shows an illustration of the radiated power as a function of the angle of radiation for the antenna element shown in FIG. 1.

FIG. 2 illustrates a radiated power of antenna element 1*a*, shown in FIG. 1, as a function of an azimuth angle θ. It will be seen that the radiation characteristic has a maximum at an angle that differs from 0°, i.e., the main direction of radiation does not run perpendicular to the substrate. As a result, antenna element 1*a* is particularly well-suited for applications in the automotive area, for example in the front or rear edge or corner region.

As FIG. 2 shows, a main direction of radiation can be achieved at an azimuth angle of approximately 25°. In addition, a high degree of stability of the radiation pattern can be achieved, such that the direction of radiation and the radiated power remain substantially constant in a bandwidth of approximately 3 gigahertz. In addition, a high radiated power can be achieved in a large angular range having a width of approximately 90° even after changing the direction of radiation. In addition, a good side lobe level can be achieved in the elevation plane, such that, in a band 3 gigahertz in width around a frequency of 76.5 gigahertz, substantially no change occurs in the main direction of radiation.

Figure 3:
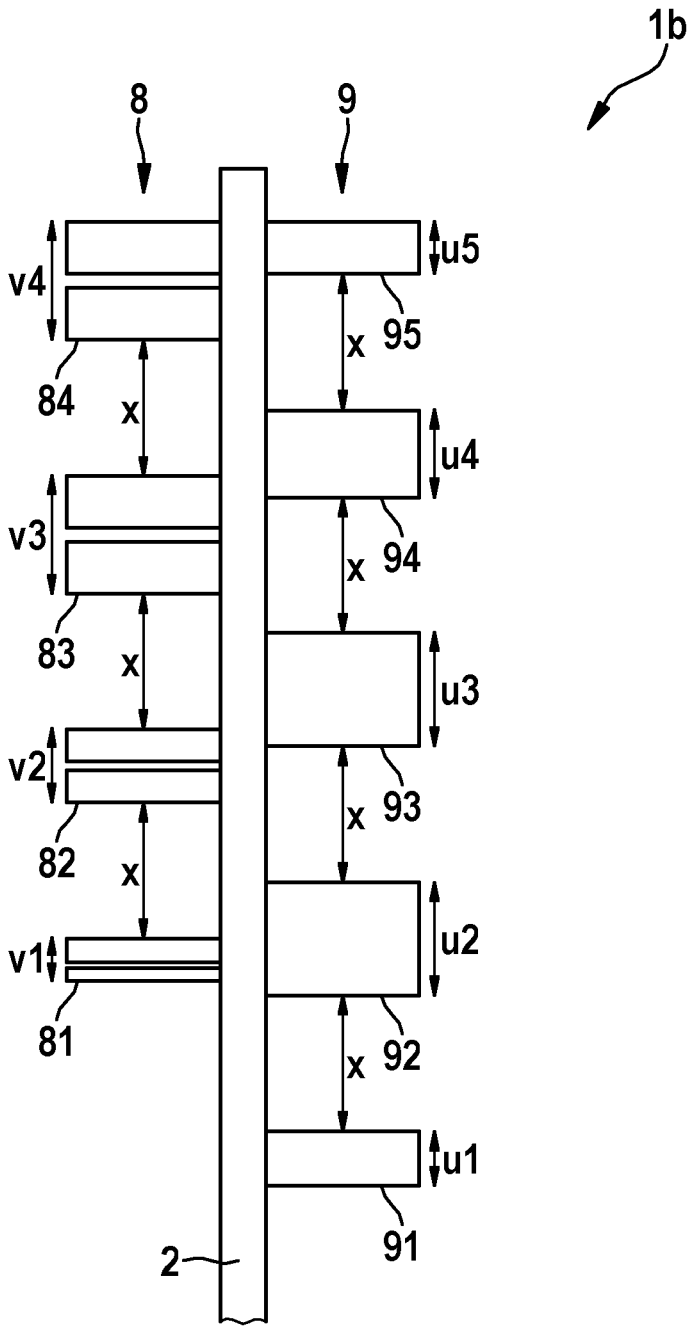
FIG. 3 shows a schematic top view of an antenna element according to a further specific embodiment of the present invention.

FIG. 3 shows an antenna element 1*b* according to a further specific embodiment of the present invention. Antenna element 1*b* has a first multiplicity 8 of radiating elements 81 to 84, where the widths v1 to v4 of radiating elements 81 to 84 follow a binomial distribution. Radiating elements 81 to 84 are each realized as slot radiating elements. In addition, antenna element 1*b* has a second multiplicity 9 of radiating elements 91 to 95, where widths u1 to u5 follow a Dolph-Chebyschev distribution. The distances x between successive radiating elements 81 to 84 and 91 to 95 are constant in each case.

The radiating elements of first multiplicity 8 and second multiplicity 9 are configured slightly offset to one another due to the different widths, in order to correspondingly adjust the phase.

Preferably, the width of the radiating elements decreases in each case towards the edge of feed line 2, as is illustrated for second multiplicity 4 of radiating elements 41 to 46 of antenna element 1*a* shown in FIG. 1, and for first multiplicity 8 and second multiplicity 9 of radiating elements of antenna element 1*b* shown in FIG. 3.

Figure 4:
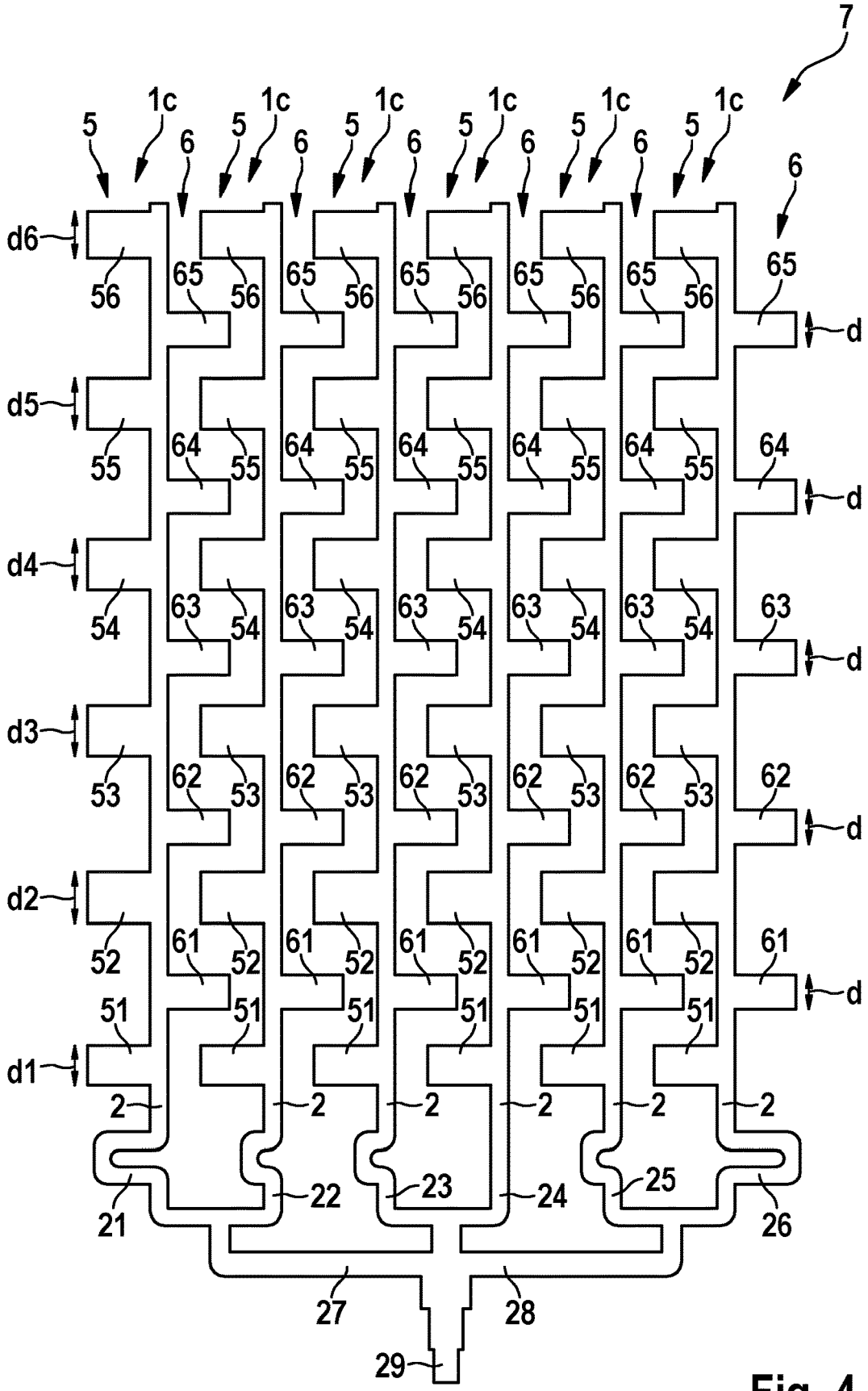
FIG. 4 shows a schematic top view of an antenna array according to a specific embodiment of the present invention.

FIG. 4 illustrates an example antenna array 7 according to the present invention. The antenna array has six antenna elements 1*c*, each having a first multiplicity 5 of radiating elements 51 to 56 having binomially distributed widths d1 to d6, and a second multiplicity 6 of radiating elements 61 to 65 having constant widths d.

Antenna elements 1*c* are each connected in pairs, via first to sixth striplines 21 to 26, to seventh and eighth striplines 27, 28, which are coupled to a ninth stripline 29. Electrical energy can be coupled into the respective striplines 2 of individual antenna elements 1*c* via ninth stripline 29. Phase differences between the individual antenna elements 1*c* can be achieved via differently selected lengths of first to sixth striplines 21 to 26, and in this way a suitable radiation characteristic can be achieved.

Instead of antenna elements 1*c* shown in FIG. 4, any antenna elements having unequally distributed radiating elements can be used, in particular antenna elements 1*a*, 1*b* shown in FIGS. 1 and 3.

Figure 5:
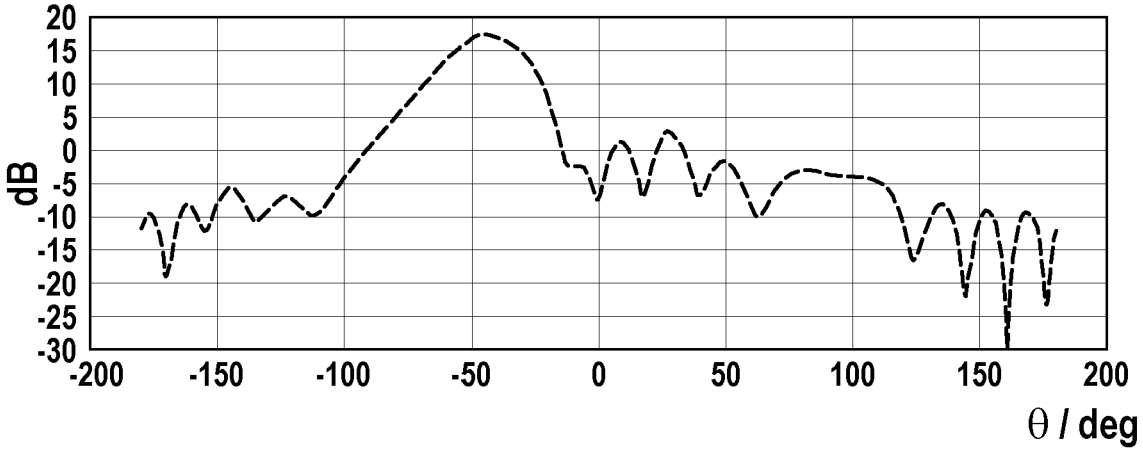
FIG. 5 shows an illustration of the radiated power as a function of the angle of radiation for the antenna array shown in FIG. 4.

FIG. 5 illustrates the radiated power of antenna array 7, shown in FIG. 4, as a function of the azimuth angle θ. The radiation characteristic has a maximum at a value of −45°. The achievable maximum is in addition significantly more pronounced than would be the case with the use of antenna elements having equally distributed radiating elements.

What is claimed is:

1. An antenna element, comprising:

a feed line configured to feed in electrical power;

a first multiplicity of radiating elements situated on a substrate on a first side of the feed line; and a second multiplicity of radiating elements situated on the substrate a second side of the feed line;

wherein:

the first and second multiplicity of radiating elements are coupled in series to the feed line, are fed with electrical power by the feed line, and are configured to transmit electromagnetic radiation; and so that a radiated maximum of the transmitted electromagnetic radiation occurs non-perpendicularly to the substrate:

distances between immediately adjacent radiating elements of the first multiplicity of radiating elements are distributed with a Dolph-Chebyshev distribution; and distances between immediately adjacent radiating elements of the second multiplicity of radiating elements are distributed with a binomial distribution, so that the distances of the second multiplicity are distributed differently than the distances of the first multiplicity.

2. The antenna element as recited in claim 1, wherein radiating elements of the first multiplicity of radiating elements and/or radiating elements of the second multiplicity of radiating elements are slotted patches.

3. The antenna element as recited in claim 1, wherein the first and second multiplicity of radiating elements are coupled to the feed line via striplines, and/or capacitive couplings, and/or slot couplings.

4. The antenna element as recited in claim 1, wherein the antenna element is a dipole antenna element.

5. The antenna element as recited in claim 1, wherein the feed line and the first and second multiplicities of radiating elements are formed as strip elements.

6. The antenna element as recited in claim 1, wherein the first multiplicity of radiating elements and the second multiplicity of radiating elements are arranged alternatingly along the feed line, and the first multiplicity of radiating elements are arranged so as to be offset relative to the second multiplicity of radiating elements along the feed line.

7. The antenna element as recited in claim 1, wherein at least one radiating element of the first multiplicity of radiating elements differs from all radiating elements of the second multiplicity of radiating elements in the width and/or in a distance to an adjacent radiating element of the first multiplicity of radiating elements.

8. The antenna element as recited in claim 1, wherein the feed line extends in a first direction, the first multiplicity of radiating elements extend in a second direction that is perpendicular to the first direction, and the second multiplicity of radiating elements extend in a third direction that is perpendicular to the first direction.

9. The antenna element as recited in claim 1, wherein the first multiplicity of radiating elements and the second multiplicity of radiating elements are distributed along a same segment of the feed line so that at least one radiating element of the first multiplicity of radiating elements (a) is closer to a first end of the feed line than at least one radiating element of the second multiplicity of radiating elements and (b) is further to the first end of the feed line than at least one other radiating element of the second multiplicity of radiating elements.

10. The antenna element as recited in claim 1, wherein the substrate is a radiofrequency substrate.

11. An antenna array, comprising:

a multiplicity of antenna elements, each of the antenna elements including:

a feed line configured to feed in electrical power;

a first multiplicity of radiating elements situated on a substrate on a first side of the feed line; and a second multiplicity of radiating elements situated on the substrate a second side of the feed line;

wherein:

the first and second multiplicity of radiating elements are coupled in series to the feed line, are fed with electrical power by the feed line, and are configured to transmit electromagnetic radiation; and so that a radiated maximum of the transmitted electromagnetic radiation occurs non-perpendicularly to the substrate:

distances between immediately adjacent radiating elements of the first multiplicity of radiating elements are distributed with a Dolph-Chebyshev distribution; and distances between immediately adjacent radiating elements of the second multiplicity of radiating elements are distributed with a binomial distribution, so that the distances of the second multiplicity are distributed differently than the distances of the first multiplicity.

12. An antenna element, comprising:

a feed line configured to feed in electrical power;

a first multiplicity of radiating elements situated on a substrate on a first side of the feed line; and a second multiplicity of radiating elements situated on the substrate a second side of the feed line;

wherein:

the first and second multiplicity of radiating elements are coupled in series to the feed line, are fed with electrical power by the feed line, and are configured to transmit electromagnetic radiation;

the first multiplicity of radiating elements differ from the second multiplicity of radiating elements in a distribution of spatial dimensions of radiating elements and/or in a distribution of distances of adjacent radiating elements such that a radiated maximum of the transmitted electromagnetic radiation occurs non-perpendicularly to the substrate;

the distribution of the spatial dimensions and/or of the distances of at least one of the first and second multiplicities of radiating elements include a Dolph-Chebyshev distribution and/or a binomial distribution; and the distribution of distances of the first multiplicity of radiating elements is such that respective distances of respective pairs of immediately adjacent ones of the radiating elements of the first multiplicity of radiating elements differ from one another, each of the respective distances being a distance separating between the respective radiating elements of the respective pair.

13. The antenna element as recited in claim 12, wherein the distances separating between immediately adjacent radiating elements of the first multiplicity of radiating elements differ from the distances separating between immediately adjacent radiating elements of the second multiplicity of radiating elements.

14. The antenna element as recited in claim 12, wherein the distribution of distances of the first multiplicity of radiating elements is the Dolph-Chebyshev distribution.

15. The antenna element as recited in claim 14, wherein the distribution of distances of the second multiplicity of radiating elements is the binomial distribution by which respective distances of respective pairs of immediately adjacent ones of the radiating elements of the second multiplicity of radiating elements differ from one another, each of the respective distances being a distance separating between the respective radiating elements of the respective pair.

16. The antenna element as recited in claim 12, wherein the distribution of the spatial dimensions of the at least one of the first and second multiplicities of radiating elements includes the binomial distribution.

17. The antenna element as recited in claim 12, wherein the distribution of distances of the at least one of the first and second multiplicities of radiating elements includes the binomial distribution.

* * * * *